US012546505B2

(12) United States Patent
Lee et al.

(10) Patent No.: US 12,546,505 B2
(45) Date of Patent: Feb. 10, 2026

(54) AIR CLEANER

(71) Applicant: LG ELECTRONICS INC., Seoul (KR)

(72) Inventors: Jongsu Lee, Seoul (KR); Juhyup Yoon, Seoul (KR); Dongryul Park, Seoul (KR); Nuree Lee, Seoul (KR); Yeonghyeon Gim, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 303 days.

(21) Appl. No.: 18/021,034

(22) PCT Filed: Aug. 20, 2021

(86) PCT No.: PCT/KR2021/011161

§ 371 (c)(1),
(2) Date: Feb. 13, 2023

(87) PCT Pub. No.: WO2022/039574

PCT Pub. Date: Feb. 24, 2022

(65) Prior Publication Data

US 2024/0035702 A1 Feb. 1, 2024

(30) Foreign Application Priority Data

Aug. 20, 2020 (KR) ..... 10-2020-0104635

(51) Int. Cl.
*F24F 13/20* (2006.01)
*F04D 25/10* (2006.01)
(Continued)

(52) U.S. Cl.
CPC ..... *F24F 13/20* (2013.01); *F24F 8/10* (2021.01); *F24F 13/1426* (2013.01)

(58) Field of Classification Search
CPC ..... F24F 8/10; F24F 13/20; F24F 8/80; F24F 13/1426; F04D 25/105
See application file for complete search history.

(56) References Cited

U.S. PATENT DOCUMENTS

2004/0250997 A1 12/2004 You
2008/0298065 A1 12/2008 Deng
2020/0208871 A1 7/2020 Yamamoto et al.

FOREIGN PATENT DOCUMENTS

CN 1938550 3/2007
CN 203628975 6/2014
(Continued)

OTHER PUBLICATIONS

KR0127607 and translation (Year: 1999).*
(Continued)

*Primary Examiner* — Steven S Anderson, II
(74) *Attorney, Agent, or Firm* — KED & ASSOCIATES

(57) ABSTRACT

An air purifier is disclosed. The air purifier includes a case having a suction port formed at a peripheral wall, an upper side of which is open; a discharge cover having a discharge port open upward, which is disposed at the open upper side of the case; a fan that is disposed inside of the case and forms a flow of air from the suction port toward the discharge port by rotation thereof; a circulator that is disposed above the discharge cover and changes a flow direction of air that flows upward through the discharge port; a rotating device that is rotatably disposed above the discharge cover and changes, into a circumferential direction, a direction that the circulator faces; a moving device movably disposed above a pivoting member, and connected to the circulator to vertically adjust a direction in which the circulator faces; a first movable gear that is rotatably disposed inside of the rotating device and engages with one side of the moving device; and
(Continued)

a first motor that is disposed inside of the rotating device and rotates the first movable gear.

19 Claims, 12 Drawing Sheets

(51) Int. Cl.

| | |
|---|---|
| ***F04D 25/16*** | (2006.01) |
| ***F24F 8/10*** | (2021.01) |
| ***F24F 13/14*** | (2006.01) |

(56) References Cited

FOREIGN PATENT DOCUMENTS

| | | | |
|---|---|---|---|
| CN | 104456899 | | 3/2015 |
| CN | 105299862 | | 2/2016 |
| CN | 105402873 | | 3/2016 |
| CN | 105980788 | | 9/2016 |
| CN | 106247588 | | 12/2016 |
| CN | 207350596 | | 5/2018 |
| CN | 209857261 | | 12/2019 |
| CN | 210050913 | | 2/2020 |
| KR | 0127607 | Y1 * | 1/1999 |
| KR | 10-2016-0012796 | | 2/2016 |
| KR | 10-1809410 | | 12/2017 |
| KR | 10-2018-0000121 | | 1/2018 |
| KR | 20180000121 | A * | 1/2018 |
| KR | 10-2018-0044131 | | 5/2018 |
| KR | 10-1897353 | | 10/2018 |
| KR | 10-2019-0014235 | | 2/2019 |
| KR | 10-2020-0056149 | | 5/2020 |
| KR | 10-2020-0072033 | | 6/2020 |
| WO | WO 2017/146355 | | 8/2017 |
| WO | WO-2017146355 | A1 * | 8/2017 ..... B01D 46/00 |

OTHER PUBLICATIONS

KR20180000121 and translation (Year: 2018).*
WO201746355 and translation (Year: 2017).*
International Search Report dated Dec. 13, 2021 issued in Application No. PCT/KR2021/011161.
Extended European Search Report dated Jul. 24, 2024 issued in Application No. 21858661.8.
Chinese Office Action dated Jun. 20, 2025, issued in Application No. 202180050827.1.
Chinese Notice of Allowance issued in Application No. 202180050827.1 dated Oct. 28, 2025.

* cited by examiner

AIR CLEANER

CROSS-REFERENCE TO RELATED PATENT APPLICATIONS

This application is a U.S. National Stage Application under 35 U.S.C. § 371 of PCT Application No. PCT/KR2021/011161, filed Aug. 20, 2021, which claims priority to Korean Patent Application No. 10-2020-0104635, filed Aug. 20, 2020, whose entire disclosures are hereby incorporated by reference.

TECHNICAL FIELD

The following description relates to an air cleaner, and more particularly to an air cleaner including a circulator.

BACKGROUND ART

An air cleaner is a device for filtering air and discharging the filtered air to a room to reduce dust and bacteria in the air of the room. The air cleaner filters out foreign matter by generating a flow of air in a room, and discharges air from which the foreign matter is removed.

There is disclosed a structure in which an inlet is formed on a circumferential surface of a cylindrical case in order to suction air over a large area of a corresponding space and to discharge filtered air, and the filtered air is discharged upwardly. However, in order to discharge the filtered air to a remote area in the corresponding space, a separate device is provided for changing an air flow direction to an upward direction in which the filtered air is discharged, thereby discharging the filtered air to a large area of a room.

Korean Laid-Open Patent Publication No. KR10-2018-0000121 discloses a blower for causing air to flow upward from a circumferential surface of a lower side thereof, and a flow switching device ("circulator") for switching a flow of air discharged upwardly. The above structure, however, has a problem in that a structure for controlling an up and down movement of the circulator is disposed on a lower surface of the circulator, thereby limiting a range of a rotation angle of the circulator that changes during up and down movement.

DISCLOSURE OF INVENTION

Technical Problem

It is an objective of the present disclosure to provide an air cleaner capable of providing a greater range of movement of purified air to improve comfort of an indoor space.

In addition, it is another objective of the present disclosure to provide an air cleaner capable of increasing a range of movement of purified air, thereby allowing purified air to be concentrated on an area desired by a user or causing purified air to flow in various directions.

It is yet another objective of the present disclosure to provide an air cleaner capable of providing stable movement of a circulator in which a direction of a discharge port changes to an up and down direction.

The objectives of the present disclosure are not limited to the aforementioned objects and other objects not described herein will be clearly understood by those skilled in the art from the following description.

Technical Solution

In order to achieve the above objectives, an air cleaner according to an embodiment of the present disclosure includes: a case having a suction port formed in a circumferential wall and having an open upper side; a discharge cover having a discharge port that is open upward and disposed on the open upper side of the case; a fan disposed inside the case, and rotating to cause air to flow from the suction port to the discharge port; a circulator disposed on an upper side of the discharge cover and configured to change a flow direction of air flowing upward through the discharge port; a rotating device rotatably disposed on an upper side of the discharge cover and changing a direction of the circulator to a circumferential direction; a moving device movably disposed on an upper side of the rotating device and coupled to the circulator to adjust the direction of the circulator upward and downward, thereby allowing the circulator to rotate in a vertical direction or a circumferential direction.

Here, the moving device may include an upper wall coupled with the circulator, and a lower wall bent downward at one end of the upper wall, having a curved surface that is convex in a direction in which the rotating device is disposed, and having a first gear rail engaged with a first moving gear, thereby increasing a range of up and down movement of the circulator.

Specifically, a screw thread of the first gear rail, which is engaged with the first moving gear, may extend in a longitudinal direction of the moving device, and the first gear rail may be formed along the lower wall forming the curved surface of the moving device, thereby increasing a range of movement of the circulator.

The first gear rail may be disposed at a center in a left-right direction of the lower wall, such that the moving device may move stably.

A stopper, disposed on one side of the first gear rail, and protruding downward from the lower wall to limit movement of the moving device, may be disposed on the lower wall, thereby limiting a range of movement of the moving device.

The rotating device may include a protrusion protruding and coming into contact with the stopper to limit movement of the moving device in one direction, thereby limiting the movement of the moving device in one direction.

A pair of guide ribs, spaced apart to be disposed on both sides of the first gear rail and extending in a direction parallel to the first gear rail, may be formed on the lower wall, thereby guiding a moving direction of the moving device.

The rotating device may include first rollers rotatably mounted thereto, wherein the first rollers come into contact with the guide ribs to prevent the moving device from moving from side to side, thereby allowing the moving device to move toward the curved surface of the lower wall.

The first rollers may be formed with a roller groove, which is recessed inward from a circumferential surface and extends circumferentially so as to remain in contact with the guide ribs, wherein the guide ribs are disposed in the roller groove of the first rollers, such that the moving device may move while the guide ribs do not deviate from a range of the roller groove of the first rollers.

The moving device may include a side wall connecting both ends of the lower wall and the upper wall, and a side guider extending in a lateral direction from a lower end of the side wall and guiding movement of the moving device, thereby guiding movement of the moving device.

A lower surface of the side guider may be horizontal to a surface of the lower wall, and a guide groove which is recessed downward may be formed in an upper surface of the side guider, thereby allowing the moving device to move along the curved surface of the lower wall of the moving device.

The rotating device may include second rollers rotating in contact with the side guider, wherein the second rollers may be inserted into the guide groove, and may rotate in contact with the side guider when the moving device moves, thereby guiding movement of the moving device.

The rotating device may include first rollers rotatably mounted to the rotating device and coming into contact with a lower surface of the moving device, and second rollers rotatably mounted to the rotating device and coming into contact with an upper surface of the moving device, such that the moving device may stably move.

The first rollers may include a first upper roller and a first lower roller disposed below the first upper roller; and the second rollers may include a second upper roller and a second lower roller disposed below the second upper roller, wherein when viewed from above, the first lower roller may be disposed between the second upper roller and the second lower roller, such that the moving device may stably move.

The upper wall may include a first upper wall connected with the lower wall and disposed on an upper side thereof; and a second upper wall connected with the first upper wall and disposed below the first upper wall.

The circulator may include a lower cover having an inlet, and an upper cover disposed on an upper side of the lower cover and having an outlet, a blower fan disposed between the lower cover and the upper cover and generating an air flow by rotation, and a motor disposed between the blower fan and the lower cover and rotating the blower fan, wherein the lower cover may include an outer plate disposed below the blower fan; a base plate radially inwardly spaced apart from the outer plate and covering a lower side of the motor of the circulator; and a connecting plate connecting the base plate and the outer plate, wherein the base plate may be disposed above the connecting plate, and a step may be formed between the base plate and the connecting plate.

The first upper wall may come into contact with the base plate, and the second upper wall may come into contact with the connecting plate, such that the circulator and the moving device may be mounted in a manner that facilitates coupling.

The upper wall may include a border rib disposed around the second upper wall, and protruding upwardly above the second upper wall, wherein the connecting plate may include a mounting part in which the border rib of the moving device may be fixedly disposed, such that the circulator and the moving device may be mounted in a manner that facilitates coupling.

A guide wall may be disposed on the base plate and the connecting plate, the guide wall coming into contact with the side wall of the moving device to limit left and right movement of the moving device, such that the circulator and the moving device may be mounted in a manner that facilitates coupling.

The discharge cover may include a circumferential wall disposed on an upper side of the case and forming a cylindrical edge, a guide base disposed inside the circumferential wall, and a plurality of discharge grills extending radially from the guide base to the circumferential wall, wherein a second moving gear for circumferentially rotating the supporter and a second motor for rotating the second moving gear may be disposed between the circumferential wall and the guide base, such that the rotating device may rotate on an upper side of the discharge cover.

A second gear rail may be formed on the rotating device, the second gear rail protruding outward from a circumferential surface and having a screw thread extending circumferentially from the circumferential surface to be engaged with the second moving gear, such that the rotating device may rotate stably.

Other detailed matters of the exemplary embodiments are included in the detailed description and the drawings.

Advantageous Effects of Invention

The air cleaner according to the present disclosure has one or more of the following effects.

It is an objective of the present disclosure to provide an air cleaner capable of providing a greater range of movement of purified air to improve comfort of an indoor space.

In addition, it is another objective of the present disclosure to provide an air cleaner capable of increasing a range of movement of purified air, thereby allowing purified air to be concentrated on an area desired by a user or causing purified air to flow in various directions.

It is yet another objective of the present disclosure to provide an air cleaner capable of providing stable movement of a circulator in which a direction of a discharge port changes to an up and down direction.

First, by increasing a range of up and down movement of the circulator, purified air may be concentrated on an area desired by a user.

Second, the moving device moves in a moving direction while each of the guide rib and the side guider is in contact with the first rollers and second rollers mounted to the rotating device, there allowing the circulator, having a heavy load due to a motor, a display, etc., to move stably.

The effects of the present disclosure are not limited to the aforesaid, and other effects not described herein will be clearly understood by those skilled in the art from the following description of the appended claims.

MODE FOR THE INVENTION

Figure 1:
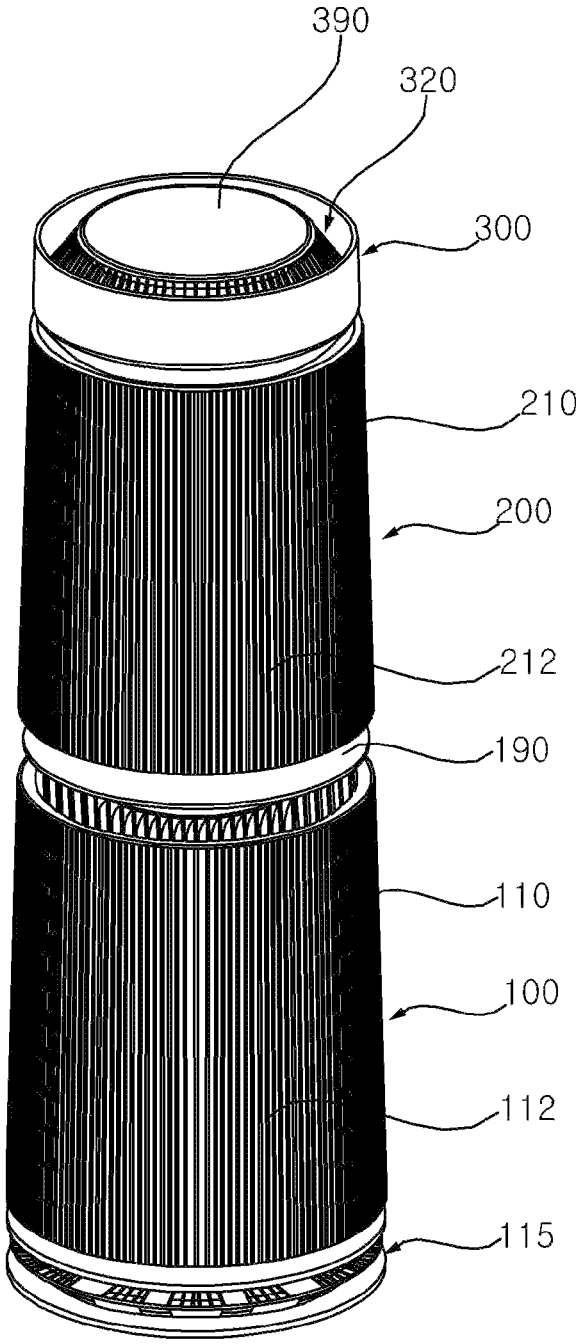
FIG. 1 is a perspective view of an air cleaner according to an embodiment of the present disclosure.

Hereinafter, the present disclosure will be described in detail with reference to the accompanying drawings, in which the same reference numerals are used throughout the drawings to designate the same or similar components, and a redundant description thereof will be omitted.

The terms "module" and "unit" for elements used in the following description are given simply in view of the ease of the description, and do not have a distinguishing meaning or role.

It will be noted that a detailed description of known arts will be omitted if it is determined that the detailed description of the known arts can obscure the embodiments of the invention. Further, the accompanying drawings are used to help easily understand various technical features and it should be understood that the embodiments presented herein are not limited by the accompanying drawings. As such, the present disclosure should be construed to extend to any alterations, equivalents and substitutes in addition to those which are particularly set out in the accompanying drawings.

It will be understood that, although the terms first, second, etc., may be used herein to describe various elements, these elements should not be limited by these terms. These terms are only used to distinguish one element from another.

It will be understood that when an element is referred to as being "connected" or "coupled" to another element, it can be directly connected or coupled to the other element or intervening elements may be present. In contrast, when an element is referred to as being "directly connected" or "directly coupled" to another element, there are no intervening elements present.

As used herein, the singular forms are intended to include the plural forms as well, unless the context clearly indicates otherwise.

Hereinafter, embodiments of the present disclosure will be described with reference to the accompanying drawings for explaining an air cleaner.

Referring to FIG. 1, an air cleaner 10 according to an embodiment of the present disclosure includes blowers 100 and 200 generating an air flow, a circulator 300 changing a discharge direction of the air flow generated by the blowers 100 and 200. The blowers 100 and 200 may include a first blower 100, and a second blower 200 disposed in a vertical direction of the first blower 100. The second blower 200 may be disposed over the first blower 100. An air flow generated by the first blower 100 may be referred to as a first air flow, and an air flow generated by the second blower 200 may be referred to as a second air flow.

Figure 2:
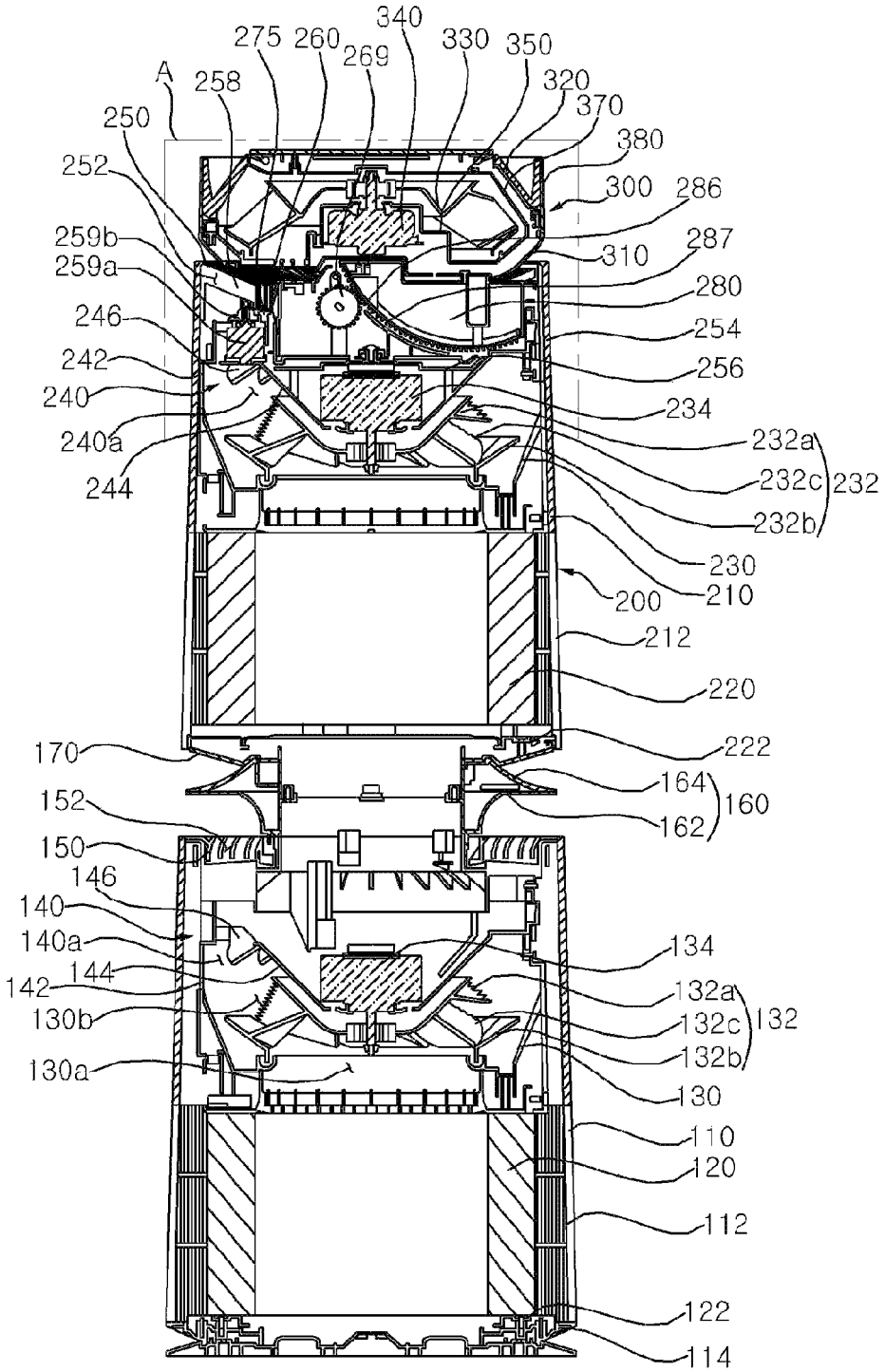
FIG. 2 is a cross-sectional view of an air cleaner according to an embodiment of the present disclosure.

Referring to FIGS. 1 and 2, the first blower 100 and the second blower 200 may be disposed vertically. The second blower 200 may be disposed over the first blower 100.

The air cleaner 10 includes cases 110 and 210 forming the exterior thereof. The cases 110 and 210 include a first case 110 forming the exterior of the first blower 100, and a second case 210 forming the exterior of the second blower 200.

The first case 110 may have a cylindrical shape. An upper part of the first case 110 may have a diameter that is smaller than a diameter of a lower part thereof. The first case 110 may have a shape with a diameter that decreases toward the top. The first case 110 may have a truncated cone shape in which a diameter of the upper part is smaller than a diameter of the lower part.

The first case 110 may have a first suction port 112 through which air is suctioned. The first suction port 112 may allow the inside and outside of the first case 110 to communicate with each other. A plurality of first suction ports 112 may be formed. The first case 110 may have the plurality of first suction ports 112 formed in a circumferential surface thereof.

The first case 110 may be opened upward. The first case 110 may have a first discharge port 152 formed in the upper part. The first case 110 may have the first discharge port 152 which is opened upward.

The plurality of first suction ports 112 may be elongated vertically. The plurality of first suction ports 112 may be arranged in a circumferential direction of the first case 110. The plurality of first suction ports 112 may be arranged evenly in the circumferential direction.

Accordingly, air may be suctioned in any direction relative to the first case 110.

Thus, an amount of intake air may increase.

A first discharge cover 150 may be disposed at the top of the first blower 100. The first discharge port 152, which is open upward, may be formed in the first discharge cover 150. The first discharge port 152 may have a ring shape.

A first filter 120 may be disposed in the first case 110. A first filter frame 122 may be provided in the first case 110, and the first filter 120 may be disposed on the filter frame 122.

A mounting space may be provided in the first case 110. The first filter 120 may be removably mounted in the mounting space. The first filter 120 has a cylindrical shape, and air may be introduced through an outer circumferential surface of the first filter 120. Impurities, such as fine dust in the air, may be filtered out while the air passes through the first filter 120.

The first filter 120 may have a cylindrical shape.

Accordingly, air introduced in any direction relative to the first filter 120 may be filtered, thereby increasing an air filtering area.

The mounting space may have a cylindrical shape corresponding to the shape of the first filter 120. During a mounting process, the first filter 120 may be slidably inserted into the mounting space. By contrast, during a removal process, the first filter 120 may be slidably withdrawn from the mounting space.

The first blower 100 includes a first fan 132 disposed in the first case 110. The first fan 132 may be rotatably disposed in the first case 110. The first fan 132 may be disposed above the first filter 120.

The first blower 110 may include a first fan housing 130 surrounding the first fan 132. The first fan housing 130 may be disposed above the first filter 120. The first fan 132 may be rotatably disposed in the first fan housing 130.

The first fan housing 130 has a first housing suction hole **130*a* formed at a lower side thereof, and a first housing discharge hole 130*b* formed at an upper side thereof. The first fan 132 suctions air in an axial direction and discharges the air in a radially upward direction. The first housing suction hole 130*a* may have a circular shape. The first housing discharge hole 130*b*** may have a ring shape.

The first blower may have a first fan motor 134 for rotating the first fan 132.

The first fan 132 includes a first hub **132*a* to which a rotating shaft of the first fan motor 134 is coupled, a first shroud 132*b* spaced apart from the first hub 132*a*, and a plurality of first blades 132*c* disposed between the first hub 132*a* and the first shroud 132*b*. The first fan motor 134 may be coupled to an upper side of the first fan 132**.

The first blower 100 may further include a first blowing guider 140 disposed at an upper side of the first fan 132, and guiding the air, having passed through the first fan 132, in an upward direction.

The first blowing guider 140 has a first air-blowing passage **140*a*, which has an annular shape, and through which the air discharged from the first fan 132** flows.

The first blowing guider 140 may include a first blower body 142 having a cylindrical shape, a bowl-shaped first motor cover 144 which is disposed at a center portion of the first blower body 142 and into which the first fan motor 134 is inserted, and a plurality of first guide vanes 146 which are circumferentially spaced apart from each other on the first air-blowing passage 140*a* disposed between the first blower body 142 and the first motor cover 144.

The first blowing guider 140 has the annular first air-blowing passage 140*a* which is formed between the first blower body 142 and the first motor cover 144, and through which the air discharged from the first fan 132 flows.

The plurality of first guide vanes 146 may guide air, discharged from the first fan 132 to the first air-blowing passage 140*a*, in an upward direction. The respective first guide vanes 146 may be formed in a curved plate shape disposed in an upright position close to a vertical direction. The first guide vanes 146 may extend from an outer circumferential surface of the first motor cover 144 to an inner circumferential surface of the first blower body 142. The plurality of first guide vanes 146 may be spaced apart from each other. The plurality of first guide vanes 146 may guide air, introduced into the first air-blowing passage 140*a* of the first blowing guider 140 after passing through the first fan 132, in an upward direction.

The first fan motor 134 may be supported on an upper side the first motor cover 144. Further, a rotating shaft of the first fan motor 134 may extend downwardly from the first fan motor 134 and may pass through a bottom surface of the first motor cover 144 to be coupled to the first hub 132*a*.

The first blower 100 may further include a base 180 provided under the lower case 110 and placed on the ground. The base 180 may be spaced apart downwardly from a lower end of the first case 110. A base suction part 114 may be formed in a separation space between the first case 110 and the base 180.

The second blower 200 may be upwardly spaced apart from the first blower 100.

The air cleaner 10 includes a divider 160 provided between the first blower 100 and the second blower 200. By providing the divider 160, the second blower 200 may be supported while being upwardly spaced apart from the first blower 100.

The divider 160 may separate or block an air flow, generated by the first blower 100, and an air flow generated by the second blower 200. By providing the divider 160, the first and second blowers 100 and 200 may be vertically spaced apart from each other.

A separation space, in which the divider 160 is disposed, is formed between the first blower 100 and the second blower 200.

The divider 160 includes a first dividing plate 162, and a second dividing plate 164 disposed over the first dividing plate 162. The first dividing plate 162 extends to be rounded upward, and the second dividing plate 164 extends to be rounded downward. The first dividing plate 162 extends upward from the first discharge cover 150. At least a portion of the first dividing plate 162 is formed as a curved surface having a predetermined radius of curvature. A PCB and a processor embedded in the PCB may be disposed in the divider 160. The processor may control the overall operation of the air cleaner.

The first discharge cover 150 of the first blower 100 may be disposed at a lower side of the divider 160, and a support plate 170 of the second blower 200 may be disposed at an upper side of the divider 160.

The second blower 200 may include the support plate 170 supporting a second filter 220 of the second blower 200. The support plate 170 has a substantially annular shape. The support plate is disposed at the upper side of the second dividing plate 164.

The support plate 170 has an annular shape and extends upwardly at an angle with respect to an axial direction from an inner circumference to an outer circumference.

The second case 210 may have a cylindrical shape. An upper part of the second case 210 may have a diameter that is smaller than a diameter of a lower part thereof. The second case 210 may have a shape with a width that decreases toward the top. The second case 210 may have a truncated cone shape in which a diameter of the upper part is smaller than a diameter of the lower part.

The second case 210 has a second suction port 212 through which air is suctioned. The second suction port 212 is elongated vertically, and a plurality of second suction ports 212 may be formed which are circumferentially spaced apart from each other.

The plurality of second suction ports 212 may be arranged evenly in the circumferential direction along an outer circumference of the second case 210, so that air may be suctioned in any direction relative to the second case 210.

The second case 210 has a similar shape to the first case 110, and the above description of the first case 210 may also apply to the second case 210.

The second blower 200 also includes the second filter 220 disposed on a second filter frame 222, and the above description of the first filter 120 and the first filter frame 122 may also apply to the second filter 220 and the second filter frame 222.

The second blower 200 may include the first fan 232 disposed in the second case 210. A second fan 232 may be rotatably disposed in the second case 210. The second fan 232 may be disposed above the first filter 220.

The second blower 210 may include a first fan housing 230 surrounding the second fan 232. The second fan housing 230 may be disposed above the second filter 220. The second fan 232 may be rotatably disposed in the second fan housing 130.

The second blower may include a second fan motor 234 for rotating the second fan, and the second fan housing 230 in which the second fan 2323 is disposed.

The second fan 232, the second fan motor 234, and the second fan housing 230 may have the same configuration with a similar shape and perform the same function as the first fan 132, the first fan motor 134, and the first fan housing 130 described above. Accordingly, the second fan 232 may be a mixed flow fan, and may include a hub 232*a*, a shroud 232*b*, and a plurality of blades 232*c*, as in the first fan 132.

The second blower 200 may further include a second blowing guider 240 disposed at an upper side of the second fan 232 and guiding air, having passed through the second fan 232, in an upward direction. The second blowing guider 240 may include a second blower body 242 having a cylindrical shape, a bowl-shaped second motor cover 244 which is disposed at a center portion of the second blower body 242 and into which the second fan motor 234 is inserted, and a plurality of second guide vanes 246 which are circumferentially spaced apart from each other on a second air-blowing passage 240*a* formed between the second blower body 242 and the second motor cover 244.

The second blower body 242, the second motor cover 244, and the plurality of second guide vanes 246 may have the same configuration with a similar shape and perform the same function as the first blower body 142, the first motor cover 144, and the plurality of first guide vanes 146 described above.

A second discharge port 252 may be formed in an upper part of the second blower 200. The second discharge port 252 may be open upward.

A second discharge cover 250 may be disposed at the top of the second blower 200. The second discharge port 252, which is open upward, may be formed in the second discharge cover 250. The second discharge port 252 may have a ring shape. A second discharge grill 258 which is formed radially from the second discharge port 252 may be disposed in the second discharge cover 250.

The air cleaner 10 includes a rotation device 260 rotatably disposed on a guide base 256 and supporting arrangement of the circulator 300, and a moving device 280 moving along the rotating device 260 and changing an inclination angle of the circulator 300. The moving device 280 may be supported by the rotating device. The rotating device 260 may be referred to as a supporter 260.

The circulator 300 may be disposed on the upper side of the second blower 200. The circulator 300 may control a wind direction of air discharged upward from the second blower 200. The circulator 300 may be disposed parallel to or at an angle to a plane formed by the second discharge port 252.

The circulator 300 may have an inlet 310*a* and an outlet 320*a*, and may cause filtered air, which is discharged from the second blower 200, to flow a long distance.

The circulator 300 is disposed on the upper side of the second blower 200. An arrangement of the circulator 300 may be changed on the upper side of the second blower 200, and may cause the air, discharged upward by the second blower 200, to flow in a radial direction.

Referring to FIG. 2, the circulator 300 includes a lower cover 310 having an inlet, an upper cover 320 having an outlet, a blower fan 330 disposed between the lower cover 310 and the upper cover 320 and generating an air flow by rotation, a motor 340 disposed between the blower fan 330 and the lower cover 310 and rotating the blower fan 330, and a motor cover 350 disposed under the blower fan 330 and disposed around the motor 340.

Referring to FIG. 2, the circulator 300 may further include a supporter 370 disposed between the upper cover 320 and the blower fan 330 and supporting the upper cover 320, an outer cover 380 covering an outside of the upper cover 320, and a display 390 (see FIG. 3) disposed on an upper side the supporter 370 and displaying an operation or status of the air cleaner 10.

Figure 3:
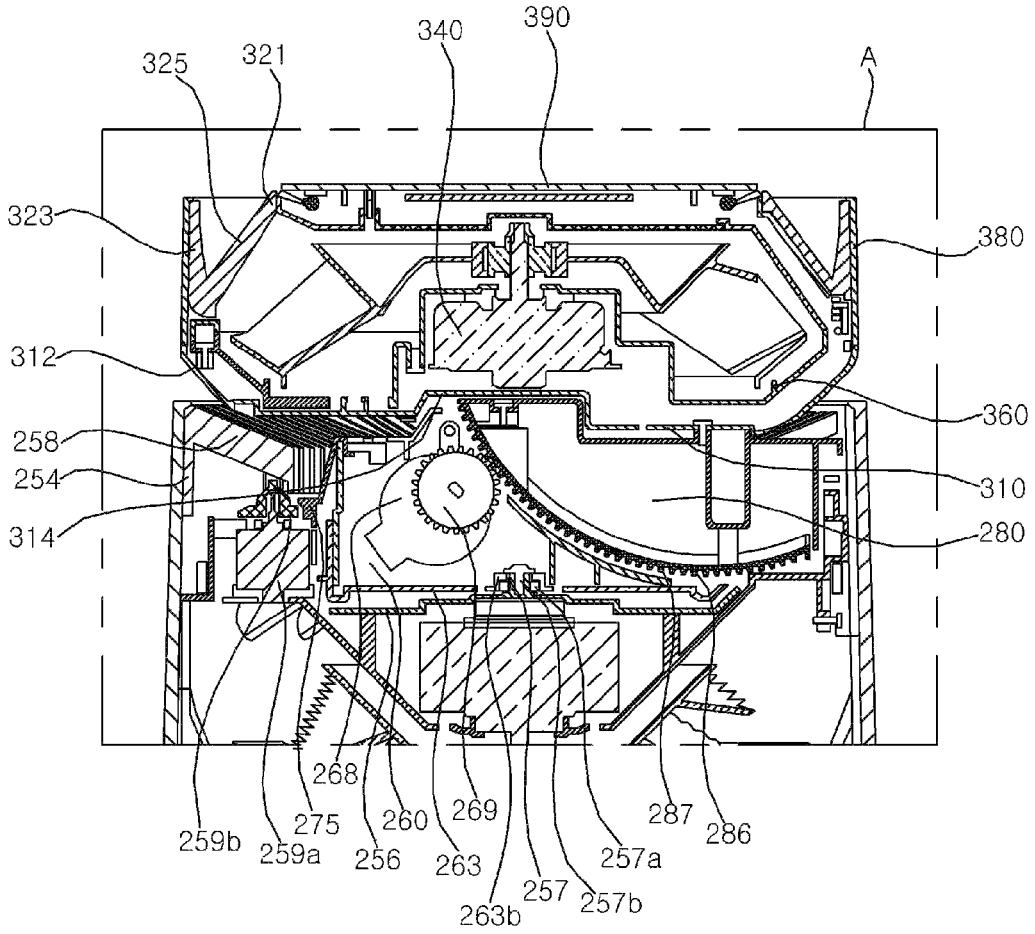
FIG. 3 is an enlarged view of portion A of FIG. 2.

Referring to FIGS. 2 and 3, the blower fan 330 may include a hub coupled to the shaft of the motor 340, a shroud spaced apart from the hub toward the inlet side of the circulator, and a plurality of blades disposed between the hub and the shroud. The hub and the shroud may have a portion which is inclined upwardly in a radially outward direction.

Referring to FIG. 3, the second discharge cover 250 includes a circumferential wall 254 disposed on an upper side of the second case 210 and forming a cylindrical edge, a guide base 256 disposed inside the circumferential wall 254, and a plurality of second discharge grills 258 extending radially from the guide base 256 to the circumferential wall 254. The rotating device 260, rotatably disposed on the guide base 256 and supporting the arrangement of the circulator 300, is disposed on an upper side of the guide base 256. The rotating device 260 is rotatably disposed on the upper side of the guide base 256, and supports the arrangement of the circulator 300.

The guide base 256 may have a disc shape, and the second discharge grill 258 may be disposed around the guide base 256. The rotating device 260 may be rotatably disposed on the guide base 256.

Referring to FIG. 3, a second motor 259*a*, rotating the rotating device 260 in a circumferential direction, and a motor cover (not shown), forming a space in which a second moving gear 259*b* is disposed, may be disposed between the circumferential wall 254 and the guide base 256. The motor cover is disposed between the plurality of second discharge grills 258.

The motor cover covers the second motor 259*a* and an upper side of the second moving gear 259*b*, and is opened to one side on which the second moving gear 259*b* is disposed. The second moving gear 259*b* is engaged with a second gear rail 275 of the rotating device 260, which will be described later, at a portion of the motor cover that is open to one side.

The second moving gear 259*b* is engaged with the second gear rail 275 to move the rotating device 260 in a circumferential direction. By rotating the second moving gear 259*b*, the second motor 259*a* may rotate the rotating device 260.

The second motor 259*a* and the second moving gear 259 may be disposed on a side opposite a moving device 280 with respect to the circumferential direction of the case 212.

The guide base 256 may have a substantially disc shape. The guide base 256 may have a boss 257 formed at the center thereof and coming into contact with the rotating device 260. The boss 257 protrudes upward from the center of the guide base 256.

A first bearing 257*a* may be disposed on an outer circumference of the boss 257. The first bearing 257*a* may be disposed between the boss 257 and a boss 263*b*, formed on a lower plate 263 of the rotating device 260, and may support a circumferential movement of the rotating device 260. The boss 257 of the guide base 256 may be referred to as a first boss 257 and the boss 263*b* of the lower plate 263 may be referred to as a second boss 263*b*. A groove 263*a* (see FIG. 7) may be formed in the boss 263*b*, and the first boss 257 and the bearing 257*a* may be disposed in the groove 263*a*.

The guide base 256 may have a first wire hole (not shown), through which an electric wire (not shown) passes. The first wire hole may be formed in the guide base 256 on a circumference of the boss 257.

The rotating device 260, rotatably disposed on the guide base 256 and supporting the arrangement of the moving device 280, is disposed on the upper side of the guide base 256. The rotating device 260 may be rotatably disposed on the upper side of the guide base 256, and may support the arrangement of the circulator 300.

Referring to FIG. 3, the air cleaner 10 includes the rotating device 260 rotatably disposed on the guide base 256 and supporting the arrangement of the circulator 300.

The rotating device 260 is rotatably disposed on the guide base 256. The rotating device 260 may be rotatably disposed at the center of the guide base 256. By rotating about the center of the guide base 256, the rotating device 260 may change a direction, in which the circulator 300 is oriented, to a circumferential direction. Here, the direction in which the circulator 300 is oriented may refer to a discharge direction of air circulated by the circulator 300. That is, the direction may refer to a direction in which the outlet 320*a* of the circulator 300 is oriented.

Figure 4:
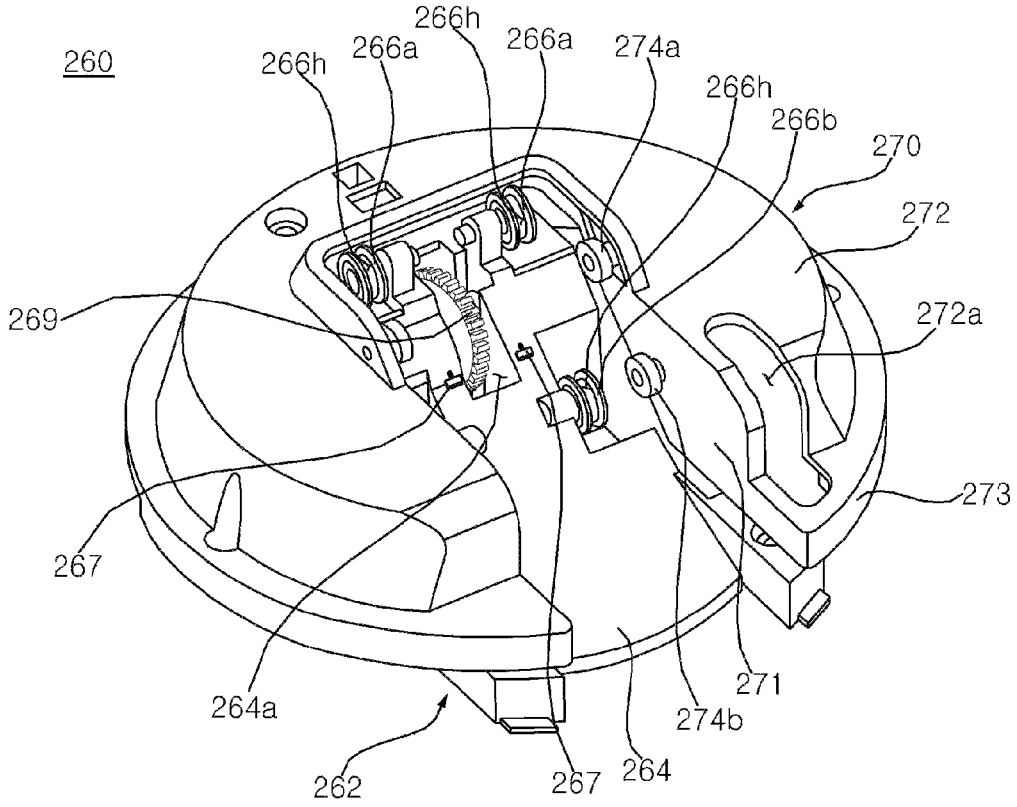
FIG. 4 is a perspective view of a rotating device according to an embodiment of the present disclosure.

Referring to FIG. 4, the rotating device 260 includes a lower body 262 rotatably connected to the upper side of the guide base 256 and having a curved surface that is convex in a direction opposite the moving device 280, and an upper body 270 coupled to an upper side of the lower body 262, and has the second gear rail 275 to allow the lower body 262 to be rotatable on the upper side of the guide base 256.

Figure 7:
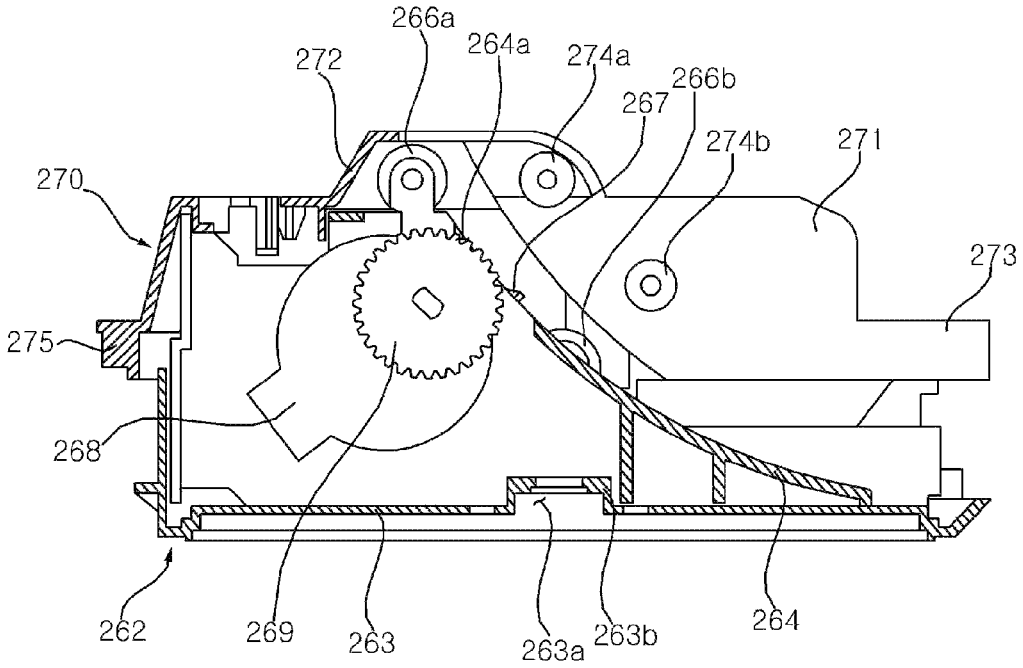
FIG. 7 is a cross-sectional view of a rotating device according to an embodiment of the present disclosure.

Referring to FIG. 7, the lower body 262 includes the lower plate 263 disposed on the upper side of the guide base 256 and rotatably connected to the guide base 256, and an upper plate 264 facing a lower wall 286 of the moving device 280 and inclined upwardly from one end of the lower plate 263. The upper plate 264 may have a curved surface that is convex in a direction opposite the moving device 280.

Figure 14:
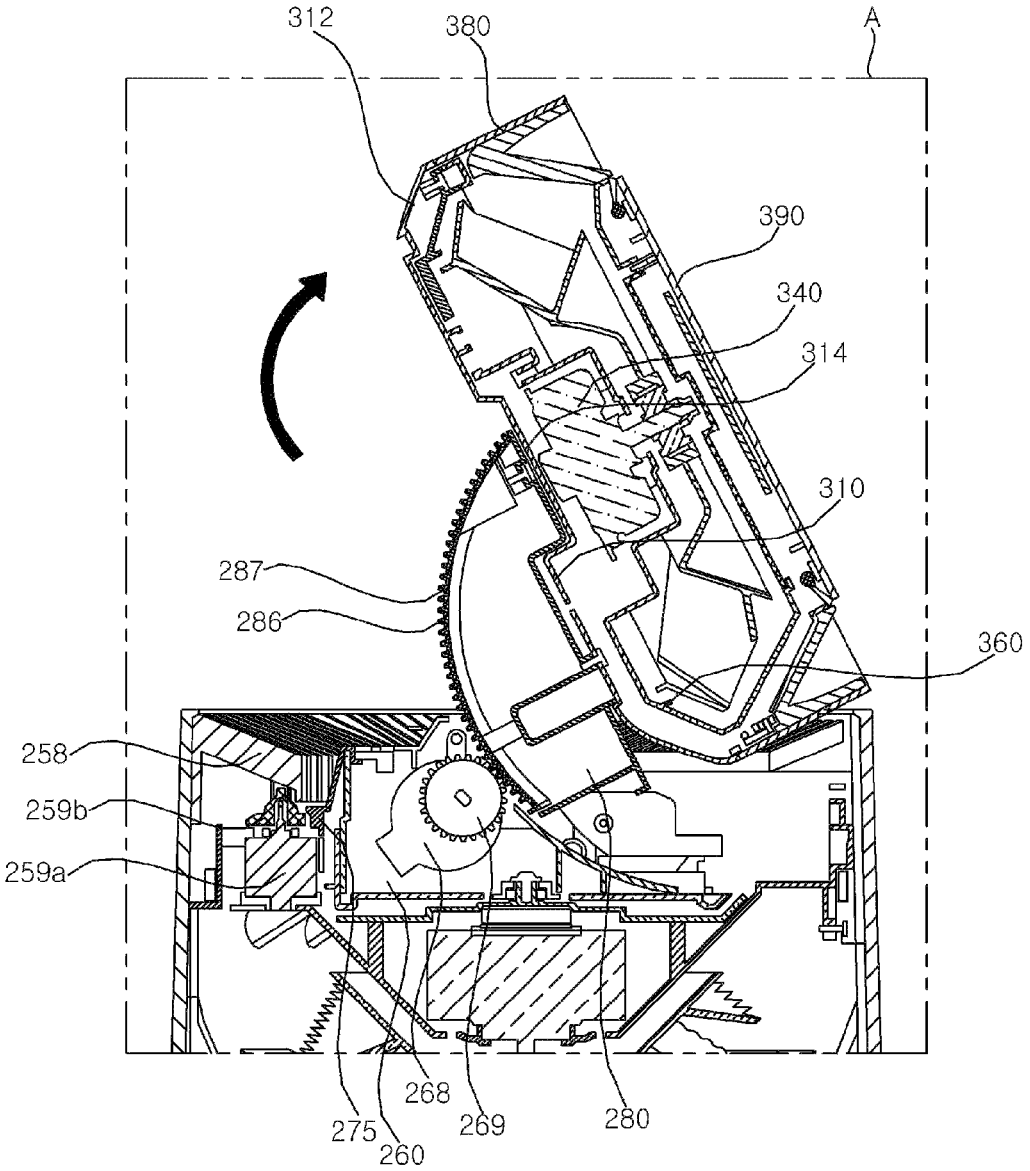
FIG. 14 is a view of a state in which a moving device and a circulator of FIG. 3 are moved.

Referring to FIGS. 3, 7, and 14, the moving device 280 may have a volume instead of a plate shape. Even when first ends of an upper wall 282 and a lower wall 286 of the moving device 280 meet each other, there may be a portion at which the walls are vertically spaced apart from each other (in a state in which the circulator is horizontally disposed). In addition, second ends of the upper wall 282 and the lower wall 286 of the moving device 280 may be spaced apart from each other and may be connected by an end wall 292. A space may be formed between the upper wall 282 and the lower wall 286. A space may be formed between the upper wall 282, the lower wall 286, and the end wall 292.

The rotating device 260 or the supporter 260 may include the upper plate 264. The upper plate 264 may form an upper surface of the supporter 260. The upper plate 264 may form a portion of the upper surface of the supporter 260. The upper plate 264 may be a component that faces the lower wall 286 of the moving device 280.

The upper plate 264 may be a component that is exposed upward when the circulator 300 and the moving device 280 are removed from the air cleaner.

Referring to FIG. 3, the groove 263*a*, which is convex upward, may be formed in the center of the lower plate 263 so as to come into contact with the boss 257 of the guide base 256. The groove 263*a* may have a shape surrounding the outer circumference of the boss 257. The first bearing 257*a* may be disposed between the groove 263*a* and the boss 257. The first bearing 257*a* may be disposed at the center of the guide base 256 and the lower plate 263, thereby stably supporting the rotation of the lower plate 263.

Figure 6:
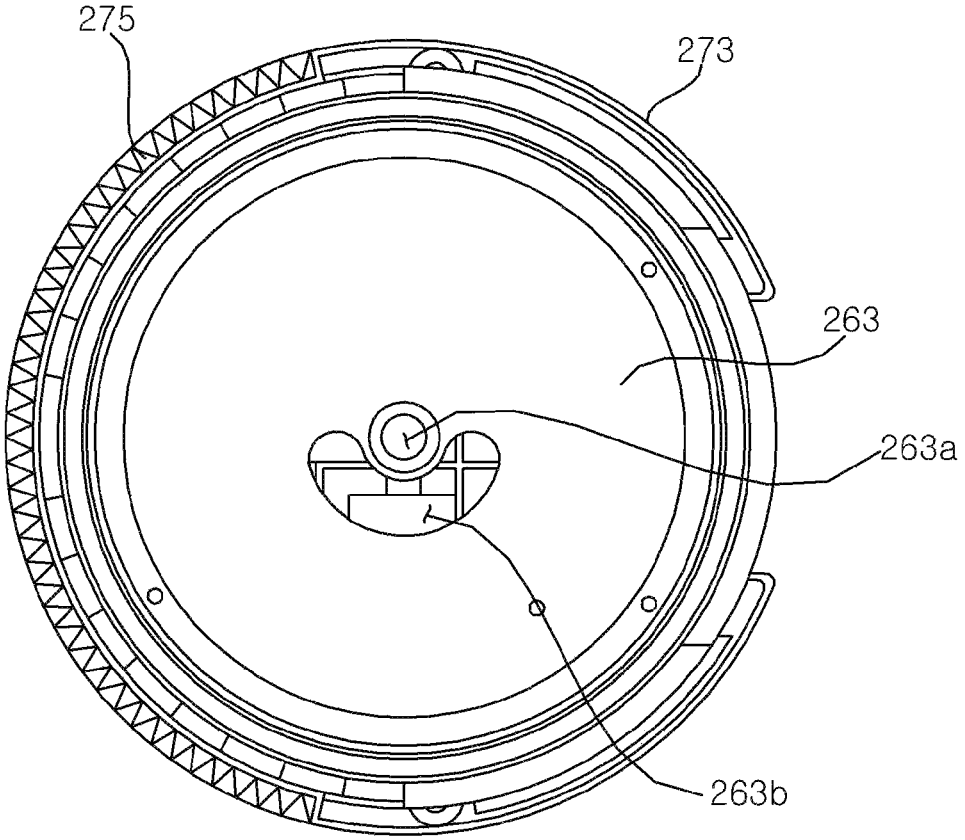
FIG. 6 is a bottom view of a rotating device according to an embodiment of the present disclosure.

Referring to FIG. 6, a second wire hole 263*b*, through which an electric wire (not shown) passes, is formed in the lower plate 263. The second wire hole 263*b* is formed around the groove 263*a* formed at the center of the lower plate 263. The second wire hole 263*b* may be larger than the first wire hole (not shown). The second wire hole 263*b* is formed in an arc shape around the groove 263*a*.

Referring to FIG. 6, the lower plate 263, having a disc shape, has the groove 263*a* formed at the center thereof.

Referring to FIG. 7, a first motor 268, and a first moving gear 269, which is rotated by the second motor, are disposed in the lower body 262. The second motor and the first moving gear 269 may be disposed in a space formed between the lower plate 263 and the upper plate 264.

Referring to FIG. 7, the upper plate 264 has a curved surface that is convex in a direction in which the guide base 256 is disposed. The upper plate 264 has a gear hole 264*a* formed so that a portion of the first moving gear 269, disposed in the space between the upper plate 264 and the lower plate 263, is exposed.

Figure 5:
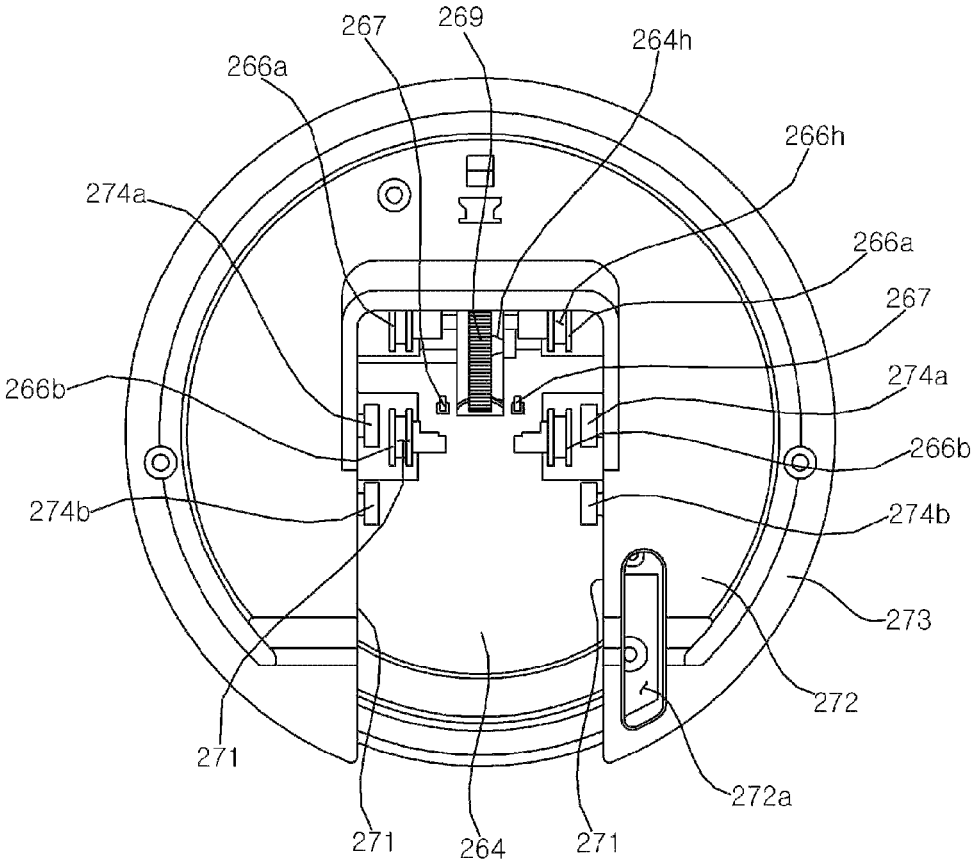
FIG. 5 is a plan view of a rotating device according to an embodiment of the present disclosure.

Referring to FIGS. 4 and 5, the upper plate 264 includes first rollers 266*a* and 266*b* coming into contact with a guide rib 286*a*, formed on the lower wall 286 of the moving device 280 and which will be described below, and preventing the moving device 280 from moving from side to side.

The first rollers 266*a* and 266*b* are rotatably mounted to the upper plate 264. The first rollers 266*a* and 266*b* may be formed with a roller groove 266*h*, which is recessed inward from a circumferential surface and extends circumferentially so as to remain in contact with the guide rib 286*a*. The guide rib 286*a* is disposed in the roller groove 266*h* of the first rollers 266*a* and 266*b*, such that the guide rib 286*a* may move along the roller groove 266*h* of the first rollers 266*a* and 266*b*.

Referring to FIGS. 4 and 5, two first rollers 266*a* and 266*b*, which are horizontally spaced apart from each other, may form a pair. The first rollers 266*a* and 266*b* may include a first upper roller 266*a*, disposed on an upper side of the upper plate 264, and a first lower roller 266*b* disposed on the upper plate 264 at a position below the first upper roller 266*a*.

Referring to FIGS. 4 and 5, a protrusion 267 protruding upward may be formed on the upper plate 264 in order to limit movement of the moving device 280 in one direction. The protrusion 267 may come into contact with a stopper 288 of the moving device 280, which will be described below, to limit the movement of the moving device 280 in one direction.

The upper body 270 is coupled to the lower body 262 at the upper side of the lower body 262. The upper body 270 is disposed on the upper side of the lower body 262 in a region other than the upper plate 264. The upper body 270 includes a pair of inner walls 271, which are vertically disposed on both sides of the upper plate 264, an outer wall 272 covering the upper side and a circumferential surface of the moving device 260, and a lower cover 273 disposed on a lower side of the outer wall 272 and coupled to the lower body 262.

Referring to FIGS. 4 and 5, second rollers 274*a* and 274*b* rotating in contact with a side guider 294, which will be described below, are disposed on each of the pair of inner walls 271. The second rollers 274*a* and 274*b* are inserted into a guide groove 295 of the side guider 294, and may rotate in contact with the side guider 294 when the moving device 280 moves.

The second rollers 274*a* and 274*b* may include a second upper roller 274*a*, disposed on the upper side of the inner wall 271, and a second lower roller 266*b* disposed below the second upper roller 274*a* and rotatably fixed to the inner wall 271.

Referring to FIG. 5, the first lower roller 266*b* is disposed between the second upper roller 274*a* and the second lower roller 274*b*, and the second upper roller 274*a* is disposed between the first upper roller 266*a* and the first lower roller 266*b*.

The first rollers 266*a* and 266*b* and the second rollers 274*a* and 274*b* may limit left and right movement of the moving device 280. In addition, the first rollers 266*a* and 266*b* may come into contact with the lower wall 286 of the moving device 280 on an upper side of the first rollers 266*a* and 266*b*, and the second rollers 274*a* and 274*b* may come into contact with the side guider 294 of the moving device 280 on a lower side of the second rollers 274*a* and 274*b*, thereby preventing up-and-down vibration of the moving device 280 when the moving device 280 moves.

Figure 9:
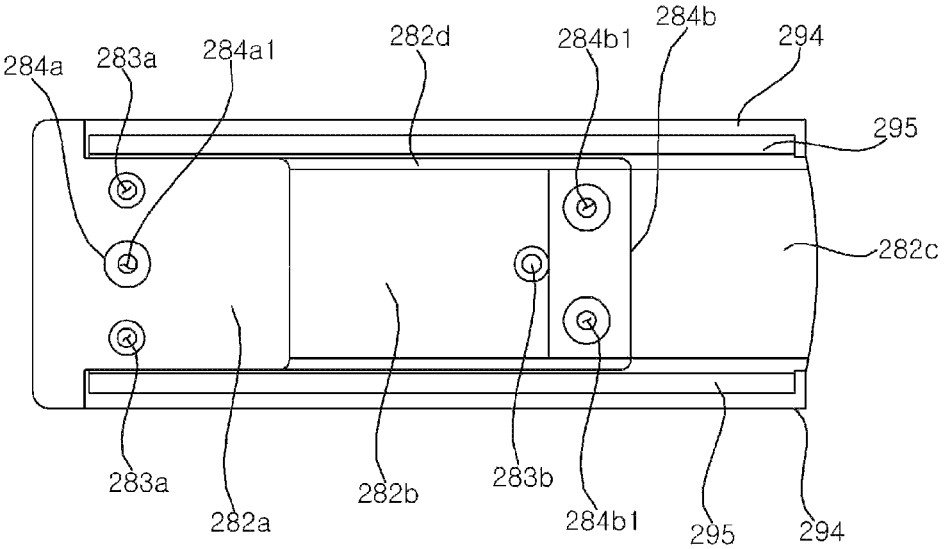
FIG. 9 is a plan view of a moving device according to an embodiment of the present disclosure.

That is, the first rollers 266*a* and 266*b* may come into contact with a lower surface of the moving device 280, and the second rollers 274*a* and 274*b* may come into contact with an upper surface of the moving device 280. Here, the lower surface of the moving device refers to a surface facing downward, and referring to FIG. 11, may be the lower wall 286 of the moving device 280. In addition, the upper surface of the moving device refers to a surface facing upward, and referring to FIG. 9, may be a surface formed to face upward from the inside of the guide groove 295 of the side guider 294.

Referring to FIGS. 6 and 7, the moving device 260 may have the second gear rail 275 protruding outward from the circumferential surface thereof and having a screw thread to be engaged with the second moving gear 259*b*.

Referring to FIGS. 6 and 7, the second gear rail 275 protrudes outward from a circumferential surface of the lower cover 273. The second gear rail 275 may be formed in a circumferential direction on the circumferential surface. The second gear rail 275 may be engaged with the second moving gear 259*b* to rotate the rotating device 260. When the rotating device 260 rotates, the moving device 280 and the circulator 300, which are disposed on the upper side thereof, rotate together.

Referring to FIG. 5, a third wire hole 272*a*, through which an electric wire (not shown) passes, is formed is in one side of an upper surface of the lower cover 273 and the outer wall 272. The third wire hole 272*a* is formed at a portion adjacent to each of the inner wall 271 and the lower cover 273 of the upper body 270. The lower cover 310 of the circulator 300 may move less at the portion adjacent to each of the inner wall 271 and the lower cover 273, thereby minimizing twisting or interference of the wire.

The moving device 280 is coupled to the circulator 300 and moves along the rotating device 260. The moving device 280 may change an inclination angle of the circulator 300. The moving device 280 may include the lower wall 286 that is convex toward the rotating device 260. A first gear rail 287, which is engaged with the first moving gear 269, is formed on the lower wall 286.

Figure 8:
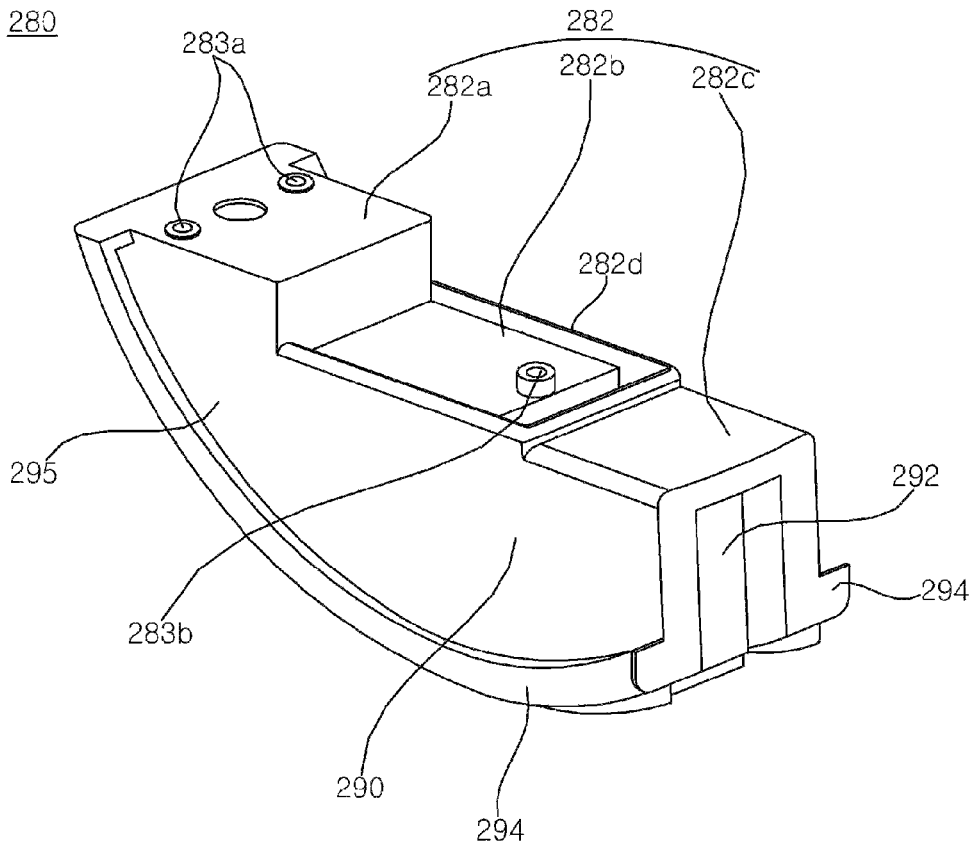
FIG. 8 is a perspective view of a moving device according to an embodiment of the present disclosure.

Referring to FIG. 8, the moving device 280 may include the upper wall 282 disposed on an upper side and coupled with the circulator 300, the lower wall 286 which is disposed below the upper wall 282 and on which the first gear rail 287 engaged with the first moving gear 269 is disposed, the end wall 292 bending vertically from one side of the upper wall 282 to extend downward and connected to the lower wall 286, a side wall 290 bending downward from both sides of the upper wall 282 and connected to the lower wall 286 and the end wall 292, and the side guider 294 extending in a lateral direction from a lower end of the side wall 290 and guiding movement of the moving device 280.

Referring to FIG. 8, the upper wall 282 may be formed in a stepped shape. The upper wall 282 having a stepped shape may facilitate coupling with the circulator 300. That is, the stepped structure of the upper wall 282 may allow the moving device 280 to be fixed to a portion at which the upper wall 282 is coupled with the circulator 300.

The upper wall 282 includes a first upper wall 282*a* connected with the lower wall 286 and disposed on an upper side thereof, a second upper wall 282*b* connected with the first upper wall 282*a* and disposed at a lower position than the first upper wall 282*a*, a third upper wall 282*c* disposed on one side of the second upper wall 282*b* and connected with the end wall 292, and a border rib 282*d* disposed around the second the second upper wall 282*b* and protruding upwardly above the second upper wall 282*b*.

The first upper wall 282*a* is disposed above the second upper wall 282*b* and the border rib 282*d*.

Figure 11:
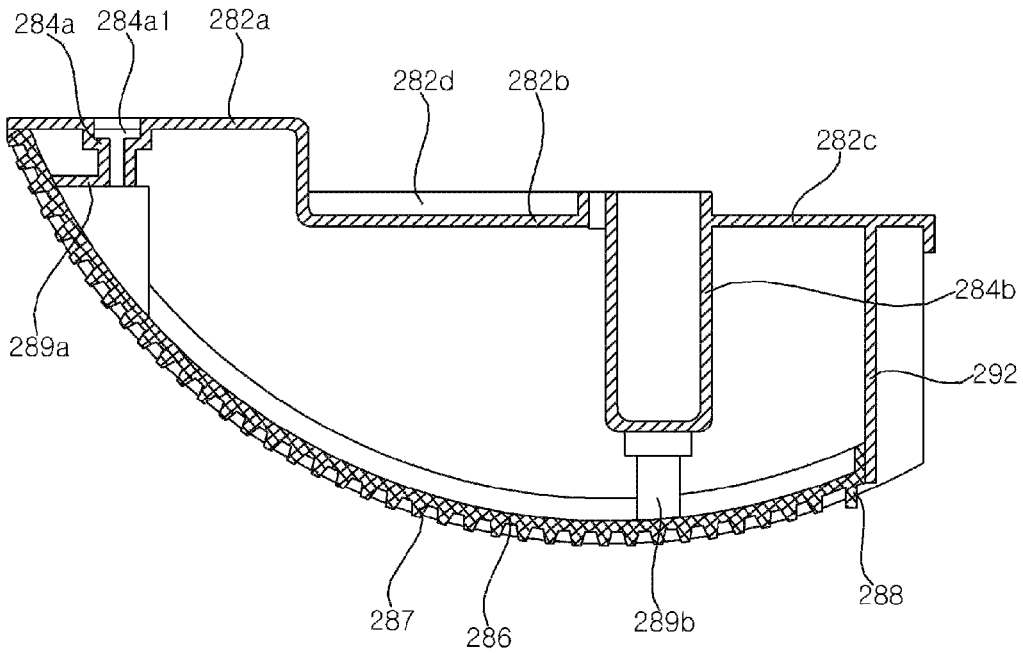
FIG. 11 is a cross-sectional view of a moving device according to an embodiment of the present disclosure.
Figure 12:
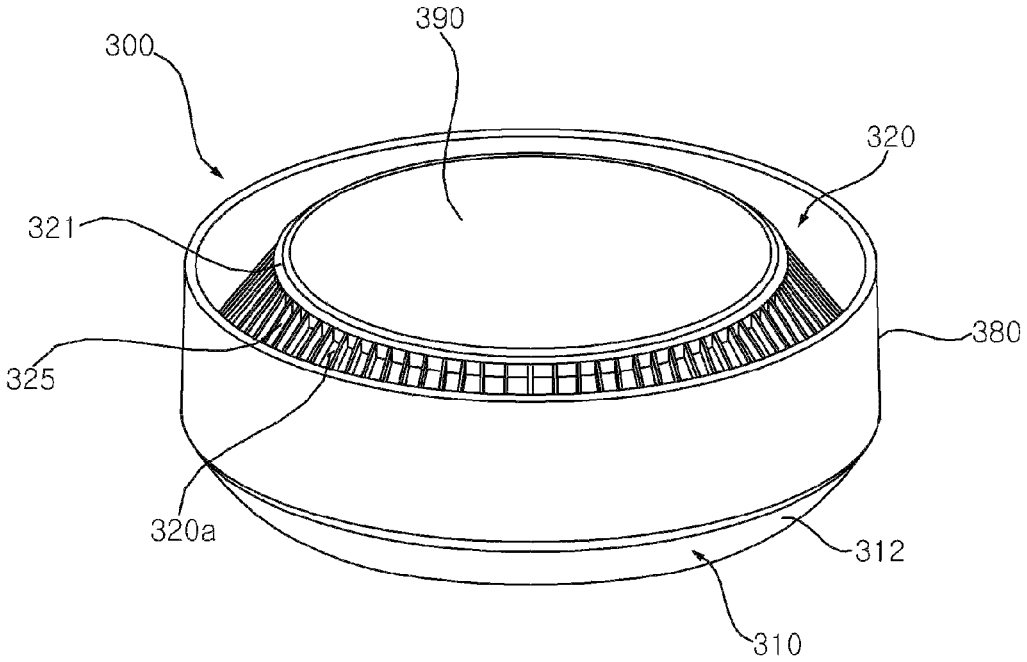
FIG. 12 is a perspective view of a circulator according to an embodiment of the present disclosure.

The first upper wall 282*a* may come into contact with a base plate 314 of the lower cover 310. A first upper hole 283*a* is formed in the first upper wall 282*a* for coupling with the circulator 300. Referring to FIGS. 8 and 11, two first upper holes 283*a* may be formed in the first upper wall 282*a*.

A second upper wall 284*a*1 may be formed in the first upper wall 282*a* for fixing with the lower wall 286. The second upper hole 284*a*1 may be formed in a first inner protrusion 284*a* protruding downward from the first upper wall 282*a*.

A first lower hole 283*b* is formed in the second upper wall 282*b* for coupling with the circulator 300. The first lower hole 283*b* may be disposed in the second upper wall 282*b* which is disposed away from the first upper hole 283*a*.

A second inner protrusion 284*b* protruding downward is formed on the second upper wall 282*b* at a position adjacent to the third upper wall 282*c*. The second inner protrusion 284*b* extends up to a position where the lower wall 286 is disposed, and may come into contact with a first upper protrusion 289*a* protruding upward from the lower wall 286.

Referring to FIGS. 3 and 8, the moving device 280 is biased to one side in a radial direction inside the case 212.

The lower wall 286 of the moving device 280 may have an arc shape. The lower wall 286 may have an arc shape that is convex downward. A center of the arc may be spaced apart from a center of rotation of the blower fan 330 in a radial direction of the circulator.

Hereinafter, a shape of the lower wall 286 will be described based on a state in which the circulator 300 is disposed horizontally. The lower wall 286 may be asymmetrical with respect to a vertical line. A portion of the lower wall 286, at which a tangent line is horizontal, may be a lowest portion of the lower wall 286. The lower wall 286 may include a first part extending from the lowest portion toward the circulator 300, and a second part extending toward the case 212. The first part may be longer than the second part.

The lowest portion of the lower wall 286 may be disposed adjacent to an upper protrusion 289*b* and the inner protrusion 284*b* which will be described later.

When the circulator 300 is disposed horizontally, a portion of the first gear rail 287, disposed in the first part of the lower wall 286, may be engaged with the first moving gear 269.

Referring to FIG. 11, the lower wall 286 has a curved surface. The first gear rail 287, formed along a longitudinal direction of the lower wall 286, is disposed on the lower wall 286, so as to adjust a direction, in which the circulator 300 is oriented, upward and downward. Here, the longitudinal direction of the lower wall 286 may refer to a direction in which the curved surface of the lower wall 286 is formed.

Figure 10:
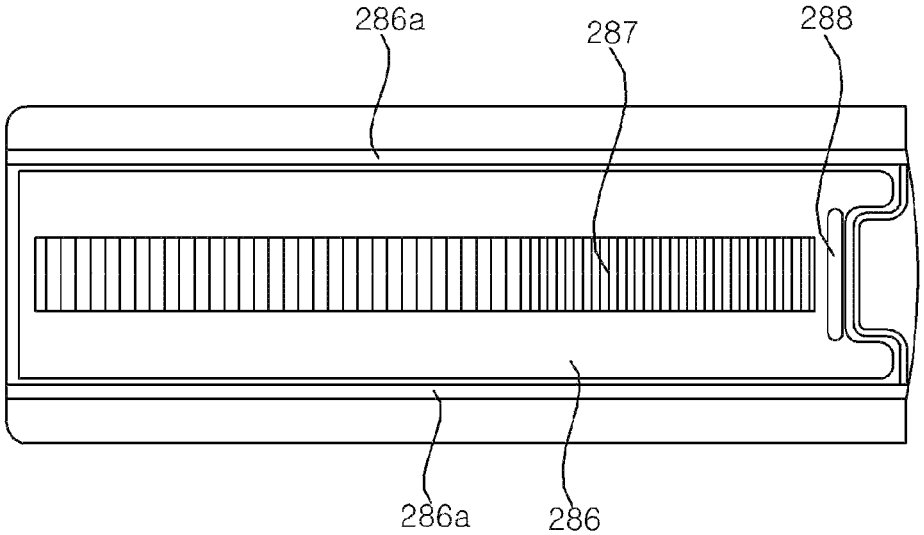
FIG. 10 is a bottom view of a moving device according to an embodiment of the present disclosure.

Referring to FIGS. 10 and 11, the first gear rail 287 of the lower wall 286 may have a screw thread disposed at the center in the left-right direction and engaged with the first moving gear 269.

The stopper 288, disposed on one side of the first gear rail 287 and coming into contact with the protrusion 267 of the rotating device 260 to limit movement of the moving device 280, is disposed on the lower wall 286. The stopper 288 may have a rib shape that protrudes downward from the lower wall 286. The stopper 288 may be disposed between the first gear rail 287 and the end wall 292.

Referring to FIG. 11, the first upper protrusion 289*a*, protruding upward to come into contact with the first inner protrusion 284*a* of the upper wall 282, and a second upper protrusion 289*b*, protruding upward to come into contact with the second inner protrusion 284*b* of the upper wall 282, may be disposed on an upper surface of the lower wall 286.

Referring to FIG. 10, a pair of guide ribs 286*a*, which are spaced apart to be disposed on both sides of the first gear rail 287 and extend in a longitudinal direction of the moving device 280 in which the first gear rail 287 extends, are formed on the lower wall 289. The pair of guide ribs 286*a* are spaced apart to be disposed on both sides of the first gear 287. The first gear rail 287 is disposed between the pair of guide ribs 286*a*. Each of the pair of guide ribs 286*a* is disposed in the roller groove 266*h* of the first rollers 266*a* and 266*b* disposed on the rotating device 260. The first rollers 266*a* and 266*b*, each having the roller groove 266*h* formed in the pair of guide ribs 286*a*, may guide movement of the moving device 280.

The side wall 290 may connect each of the upper wall 282, the lower wall 286, and the end wall 292, and may have the side guider 294 disposed at a lower end thereof.

Referring to FIG. 8, the side guider 294 protrudes outward from the lower end of the side wall 290. A lower surface of the side guider 294 is horizontal to a surface of the lower wall 286. The guide groove 295, which is recessed downward, is formed in an upper surface of the side guider 294. The second rollers 274*a* and 274*b* of the rotating device 260 are disposed in the guide groove 295 of the side guider 294. Accordingly, the second rollers 274*a* and 274*b*, disposed in the guide groove 295 of the side guider 294, may prevent the moving device 280 from vibrating in an upward direction which is different from a moving direction when the moving device 280 moves.

The moving device 280 may include a lower housing 280*b* covering a lower side thereof and disposed on an upper side of the rotating device 260, and an upper housing 280*a* disposed on an upper side of the lower housing 280*b* and coupled to the circulator 300.

Referring to FIG. 8, the upper housing 280*a* may include the upper wall 282, the end wall 292, the side wall 290, and the side guider 294, and the lower housing 280*b* may include the lower wall 286.

The circulator 300 is coupled to the moving device 280 via the lower cover 310.

Figure 13:
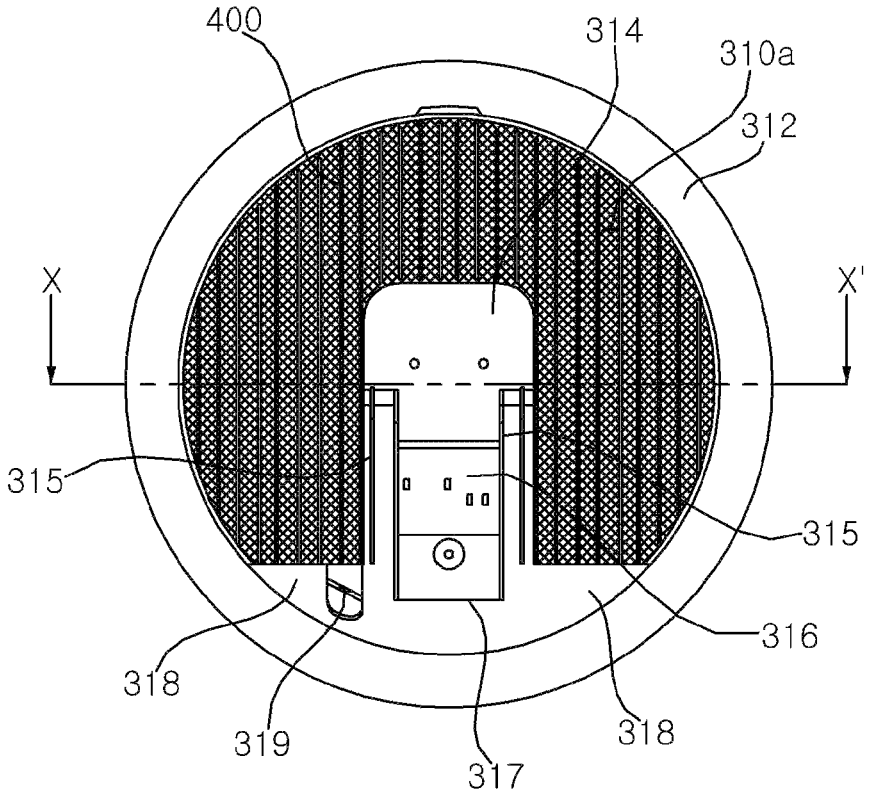
FIG. 13 is a bottom view of a circulator according to an embodiment of the present disclosure.

Referring to FIG. 13, the lower cover 310 includes an outer plate 312 disposed below the blower fan 330, the base plate 314 radially inwardly spaced apart from the outer plate 312 and covering a lower side of the motor 340, and a connecting plate 316 connecting the base plate 314 and the outer plate 312.

A plurality of ribs (not shown) for connecting the base plate 314 and the outer plate 312 may be disposed at the inlet 310*a* formed between the base plate 314 and the outer plate 312. A filter 400 for filtering out foreign matter from the air entering the circulator 300 may be disposed in the lower cover 310. The filter 400 may be disposed at the inlet formed between the outer plate 312 and the base plate 314.

Referring to FIG. 3, the outer plate 312 has a shape extending upward in a radially outward direction. At least a portion of the outer plate 312 may have a curved shape that is convex outward. The curved shape may allow a portion of the air, discharged upward, to flow along a surface of the outer plate 312 in a direction in which the outlet 320*a* of the circulator 300 is oriented.

Referring to FIG. 13, the base plate 314 is disposed at the center of the lower cover 310. The base plate 314 covers the center of the inlet 310*a* formed in the lower cover 310. That is, a suction port 330*a* of the blower fan 330 is closed in a partial region by the base plate 314. The base plate 314 is connected with the moving device 280 that changes position of the circulator 300.

Referring to FIG. 13, the connecting plate 316 extends radially outward from one side of the base plate 314 and is connected to the outer plate 312. The connecting plate 316 may be coupled to the base plate 314 and the moving device 280.

The base plate 314 may be formed above the connecting plate 316, and a step may be formed between the base plate 314 and the connecting plate 136. A guide wall 315, coming into contact with the side wall 290 of the moving device 280 to limit the left and right movement of the moving device 280, is disposed on the base plate 314 and the connecting plate 316. A pair of guide walls 315, which are space apart from each other, are formed on the base plate 314 and the connecting plate 316 and protrude downwardly.

The connecting plate 316 may include a mounting part 317 in which the border rib 282*d* of the moving device 280 is fixedly disposed. The mounting part 317 is disposed on the outside of the border rib 282*d* of the moving device 280 to surround the border rib 282*d*, thereby allowing the moving device 280 to be stably mounted to the lower cover 310. The guide walls 315 may be disposed on both sides of the mounting part 317. The mounting part 317 and the guide walls 315 may fix the position of the moving device 280, disposed in the lower cover 310, thereby facilitating coupling thereof.

Referring to FIG. 13, the lower cover 310 includes a side plate 318 extending vertically from the connecting plate 316 disposed adjacent to the outer plate 312. The side plate 318 extends from both ends of the connecting plate 138 in a direction perpendicular to the connecting plate 316. The side plate 318 extends vertically from the connecting plate 316, to be connected to the outer plate 312.

A fourth wire hole 319, through which an electric wire extending from the blowers 100 and 200 passes, is formed in the side plate 318.

Referring to FIGS. 3 and 14, the moving device 280 may be moved by rotation of the first moving gear 269 disposed in the rotating device 160. By the movement of the moving device 280, a direction in which the circulator 300 is oriented may be adjusted upward and downward.

Referring to FIGS. 3 and 14, the circulator 300 may rotate about the center of an imaginary circle that extends from the lower wall 286. The circulator 300 may be tilted relative to the case 212 or a horizontal direction, and the center of the circulator 300 may move upward and downward. As the center of the circulator 300 moves upward, the circulator 300 may move vertically, and as the center thereof moves downward, the circulator 300 may move horizontally.

The center of the imaginary circle extending from the lower wall 286, i.e., the center of rotation around which the circulator is tilted, may be spaced apart from the center of rotation of the blower fan of the circulator. The center of the imaginary circle extending from the lower wall 286 may be located in the circulator.

FIG. 3 illustrates a state in which the circulator 300 is disposed horizontally, and FIG. 14 illustrates a state in which the circulator 300 is tilted at a maximum angle relative to the horizontal direction. The state of FIG. 3 may be defined as a stop position of the circulator 300, and the state of FIG. 14 may be defined as an operating position of the circulator 300.

When the circulator 300 is in a stop state, an upper circumference of an outer cover may be defined as a discharge end of the outer cover. In the discharge end of the outer cover 380, a portion corresponding to the case 212 or the moving device 280 in a circumferential direction of the circulator 300 may be disposed above the upper edge of the case 212 when the circulator 300 is in an operating state. In addition, the portion may be disposed adjacent to the upper edge of the case in a radial direction when the circulator 300 is in the operating state. Further, even during movement of the circulator 300 to change from the operating state to the stop state or from the stop state to the operating state, the portion may be disposed adjacent to the upper edge of the case in the radial direction of the case.

Certain embodiments or other embodiments of the present disclosure described above are not mutually exclusive or distinct from each other. Any or all elements of the embodiments of the present disclosure described above may be combined or combined with each other in configuration or function.

For example, a configuration "A" described in one embodiment of the invention and/or the drawings and a configuration "B" described in another embodiment of the invention and/or the drawings may be combined with each other. Namely, although the combination between the configurations is not directly described, the combination is possible except in the case where it is described that the combination is impossible.

The foregoing embodiments are merely examples and are not to be considered as limiting the present disclosure. The scope of the present disclosure should be determined by rational interpretation of the appended claims, and all modifications within the equivalents of the disclosure are intended to be included within the scope of the present disclosure.

The invention claimed is:

1. An air cleaner, comprising:

a case that extends vertically, and having a suction port and an open upper side;

a discharge cover disposed on the open upper side of the case, and having a discharge port that is open upward;

a fan that is disposed inside of the case, and causes air to flow from the suction port to the discharge port;

a circulator disposed on an upper side of the discharge cover, having a blower fan, and configured to change a flow direction of air flowing upward through the discharge port;

a supporter that is disposed on the upper side of the case and below the circulator, supports the circulator, and includes a moving gear and a first motor configured to rotate the moving gear;

a moving device movably supported by the supporter, and coupled to the circulator, and including a gear rail configured to engage with the moving gear, wherein the moving device comprises:

an upper wall having a flat top surface and coupled with the circulator;

a lower wall that extends downward in a convex arc shape from a first end of the upper wall, wherein a first end of the lower wall is spaced apart from a second end of the upper wall in a longitudinal direction of a rotational shaft of the blower fan, and wherein a guide rail is formed on a lower surface of the lower wall; and a side wall that extends from one side edge of the upper wall, which intersect with the second end of the upper wall, toward the lower wall in a rotational direction of the blower fan.

2. The air cleaner of claim 1, wherein the first gear rail is disposed at a center in a lateral direction of the lower wall.

3. The air cleaner of claim 1, further comprising:

a stopper that protrudes from the lower wall, and disposed opposite the circulator with respect to the first gear rail to limit movement of the moving device; and a protrusion disposed opposite the circulator with respect to the first moving gear in a moving direction of the moving device, and coming into contact with the stopper to limit movement of the moving device in one direction.

4. The air cleaner of claim 1, wherein the supporter comprises first rollers rotatably mounted and coming into contact with the lower wall.

5. The air cleaner of claim 4, wherein the first rollers have a roller groove recessed from a circumferential surface thereof and extending in a circumferential direction, and wherein the lower wall further comprises a guide rib that extends in parallel to the first gear rail and is inserted into the roller groove of the first rollers.

6. The air cleaner of claim 4, wherein the moving device further comprises:

a side guider that protrudes from the side wall in a width direction of the moving device, and extends along the lower wall, and wherein the supporter comprises second rollers that rotate in contact with an upper surface of the side guider.

7. The air cleaner of claim 1, further comprising:

first rollers rotatably mounted to the supporter and coming into contact with a surface facing a lower side of the moving device; and second rollers rotatably mounted to the supporter and coming into contact with a surface facing an upper side of the moving device.

8. The air cleaner of claim 7, wherein:

the first rollers comprise a first upper roller and a first lower roller disposed below the first upper roller; and the second rollers comprise a second upper roller and a second lower roller disposed below the second upper roller, and wherein when viewed from above, the first lower roller is disposed between the second upper roller and the second lower roller.

9. The air cleaner of claim 1, wherein the moving device further comprises an end wall that connects the second end of the upper wall and the first end of the lower wall, and facing toward the inner wall of the case when the circulator is disposed horizontally, wherein the second end of the lower wall, which is disposed adjacent to the circulator, is connected to the upper wall, and the first end of the lower wall is connected to the end wall.

10. The air cleaner of claim 1, wherein the circulator comprises a lower cover having an inlet, and an upper cover disposed on an upper side of the lower cover and having an outlet, and a motor that is disposed between the blower fan and the lower cover and rotates the blower fan, wherein the blower fan comprises:

a hub coupled to a shaft of the motor;

a shroud spaced apart from the hub toward the inlet of the circulator; and a plurality of blades provided between the hub and the shroud, and wherein the hub and the shroud have a portion which is inclined upwardly in a radially outward direction.

11. The air cleaner of claim 10, wherein the lower cover comprises an outer plate that forms an outer circumference thereof, and wherein the outer plate is inclined upwardly in an outward direction.

12. The air cleaner of claim 11, wherein the circulator comprises a cylindrical outer cover that forms an outer circumference thereof, and wherein a lower end of the outer cover meets an upper end of the outer plate.

13. The air cleaner of claim 10, wherein the upper cover comprises:

an inner rim;

an outer rim disposed radially outward from the inner rim; and a plurality of vanes that forms the outlet of the circulator, connects the inner rim and the outer rim, and is inclined downwardly in an outward direction.

14. The air cleaner of claim 10, wherein the upper wall comprises:

a first upper wall connected with the lower wall and disposed on an upper side thereof; and a second upper wall connected with the first upper wall and disposed below the first upper wall, wherein the lower cover comprises:

an outer plate disposed below the blower fan;

a base plate that is radially inwardly spaced apart from the outer plate and covers a lower side of the motor of the circulator; and a connecting plate that connects the base plate and the outer plate, wherein the base plate is disposed above the connecting plate, and wherein a step is formed between the base plate and the connecting plate.

15. The air cleaner of claim 14, wherein the upper wall comprises a border rib that is disposed around the second upper wall and protrudes upwardly above the second upper wall, and wherein the connecting plate comprises a mounting portion in which the border rib of the moving device is fixedly disposed.

16. The air cleaner of claim 14, wherein a guide wall is disposed on the base plate and the connecting plate, the guide wall coming into contact with the side wall of the moving device to limit lateral movement of the moving device.

17. The air cleaner of claim 1, wherein the discharge cover comprises a circumferential wall that is disposed on an upper side of the case and forms a cylindrical edge, a guide base disposed inside of the circumferential wall, and a plurality of discharge grills that extends radially from the guide base to the circumferential wall, and wherein a second moving gear that circumferentially rotates the supporter and a second motor that rotates the second moving gear are disposed between the circumferential wall and the guide base.

18. The air cleaner of claim 17, wherein a second gear rail is formed on the supporter, the second gear rail protruding outward from a circumferential surface and having a screw thread extending circumferentially from the circumferential surface to be engaged with the second moving gear.

19. The air cleaner of claim 1, wherein the circulator, comprises:

a base plate disposed at a rear side of the blower fan and to which the upper wall is coupled; and a connecting plate that extends radially outward from one side of the base plate and forming a step behind the base plate, and wherein the upper wall comprises:

a first upper wall that contacts the base plate; and a second upper wall that forms a lower step from the first upper wall and contacts the connection plate.

* * * * *